US006966267B2

(12) United States Patent
Bienick

(10) Patent No.: US 6,966,267 B2
(45) Date of Patent: Nov. 22, 2005

(54) REFRIGERATOR COMPARTMENT HOUSING VERTICALLY ADJUSTABLE SHELVES

(75) Inventor: Craig Bienick, Jenison, MI (US)

(73) Assignee: Gemtron Corporation, Sweetwater, TN (US)

( * ) Notice: Subject to any disclaimer, the term of this patent is extended or adjusted under 35 U.S.C. 154(b) by 244 days.

(21) Appl. No.: 10/355,102

(22) Filed: Jan. 31, 2003

(65) Prior Publication Data

US 2004/0149181 A1 Aug. 5, 2004

(51) Int. Cl.[7] ..... A47B 9/00
(52) U.S. Cl. ..... 108/108; 108/147.17; 312/408
(58) Field of Search ..... 108/106, 107, 108/108–110, 147.16, 147.17; 211/187, 193; 248/241, 243–246; 312/408, 410

(56) References Cited

U.S. PATENT DOCUMENTS

| | | | | |
|---|---|---|---|---|
| 569,640 | A | 10/1896 | Hartzell | |
| 984,857 | A | 2/1911 | Schuftan | |
| RE19,798 | E | 12/1935 | Copeman | |
| 2,841,459 | A | 7/1958 | Sharpe | |
| 3,172,715 | A | 3/1965 | Powder | |
| 3,299,839 | A | 1/1967 | Nordbak | |
| 3,316,044 | A | 4/1967 | Carbary | |
| 3,479,974 | A | 11/1969 | Ferdinand et al. | |
| 3,536,015 | A | 10/1970 | Textoris | |
| 3,702,137 | A | 11/1972 | Evans | |
| 3,834,659 | A | 9/1974 | Siegel | |
| 3,888,440 | A | 6/1975 | Rebentisch | |
| 4,250,815 | A | 2/1981 | Swanson | |
| 4,934,645 | A * | 6/1990 | Breslow | 248/242 |
| 5,088,607 | A * | 2/1992 | Risafi et al. | 211/187 |
| 5,441,338 | A * | 8/1995 | Kane et al. | 312/408 |
| 5,735,222 | A * | 4/1998 | Webb | 108/110 |
| 5,913,584 | A * | 6/1999 | Swindell et al. | 312/408 |
| 5,921,411 | A * | 7/1999 | Merl | 108/108 |
| 6,065,821 | A | 5/2000 | Anderson et al. | |
| 6,168,032 | B1 * | 1/2001 | Merl | 248/242 |
| 6,196,141 | B1 | 3/2001 | Herron, III et al. | |
| 6,227,636 | B1 | 5/2001 | Lye et al. | |
| 6,584,916 | B1 * | 7/2003 | Felton et al. | 108/107 |
| 6,675,725 | B2 * | 1/2004 | Felton et al. | 108/107 |
| 2002/0027115 | A1 * | 3/2002 | Gay et al. | 211/187 |

FOREIGN PATENT DOCUMENTS

| | | | | |
|---|---|---|---|---|
| CH | 665759 | * | 6/1988 | 108/110 |
| EP | 0235448 | * | 9/1987 | 108/108 |

* cited by examiner

*Primary Examiner*—Janet M. Wilkens
*Assistant Examiner*—Hanh V. Tran
(74) *Attorney, Agent, or Firm*—Diller, Ramik & Wight

(57) ABSTRACT

A shelf assembly includes a pair of shelf brackets secured to a rim which carries a planar support. The shelf brackets include oppositely directed pins spaced a predetermined distance from each other which correspond to a plurality of slots in a pair of mirror image adapter brackets each having a vertical slideway associated with the slots. The adapter brackets have hooks for engaging slots in vertical shelf tracks of a refrigerator compartment to effect "coarse" vertical adjustment of the shelf assembly. However, the shelf can be "fine tuned" vertically adjusted by moving the pins of the shelf brackets along the sideways and into selected pairs of the adapter bracket slots.

71 Claims, 6 Drawing Sheets

FIG. 4
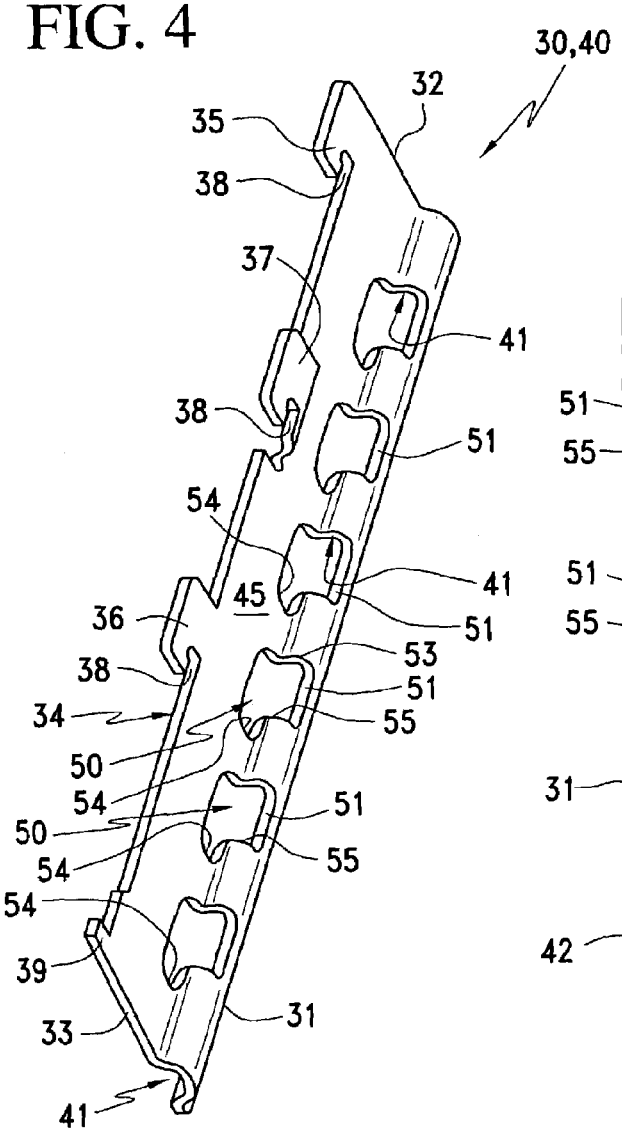
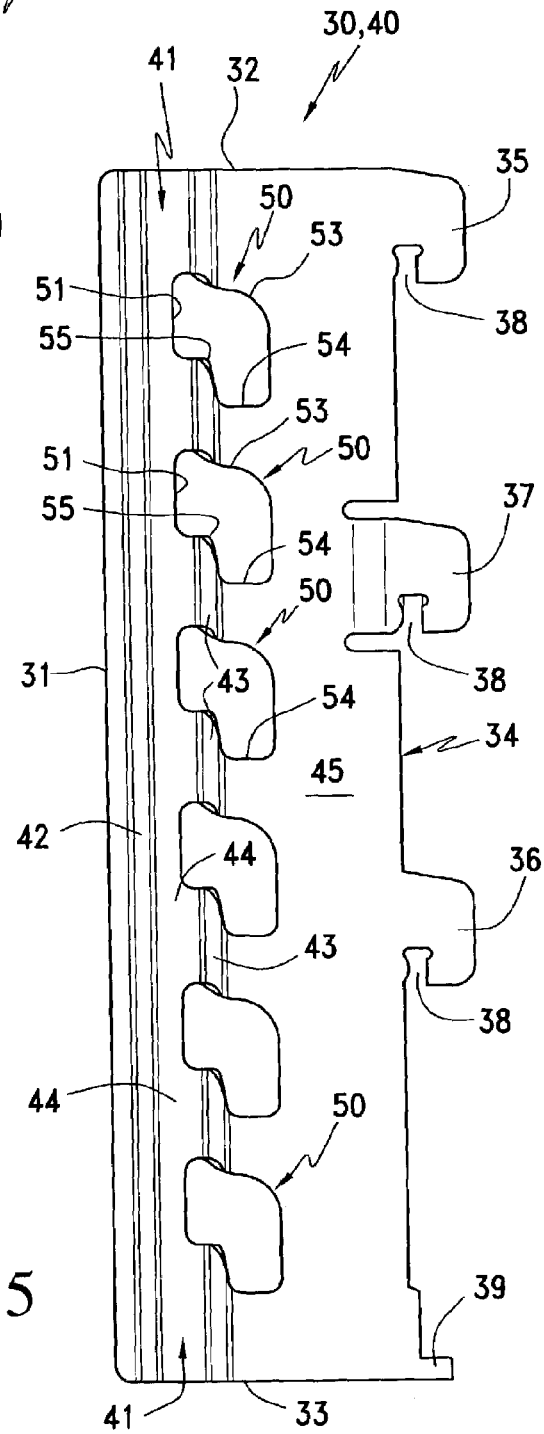
FIG. 5

REFRIGERATOR COMPARTMENT HOUSING VERTICALLY ADJUSTABLE SHELVES

BACKGROUND OF THE INVENTION

This invention relates to shelving particularly for refrigerators, but is equally adapted for utilization in a variety of different environments, such as furniture shelves, cabinet shelves, point-of-sale displays, and the like.

A conventional refrigerator shelf typically includes a substantially planar shelf member, and a pair of metal shelf brackets connected to the shelf member, preferably by an injection molded resinous peripheral encapsulation, rim or border. The support brackets typically include a pair of hooks which are received in pairs of slots carried by vertical shelf supports, channels or tracks secured to or forming an integral portion of a rear wall of a refrigerator compartment. The shelves can be step-adjusted along the vertical supports in a convention manner by hooking and unhooking the shelf brackets relative to the vertical supports or tracks. The latter is readily accomplished when the shelf is devoid of any products/articles. However, if relatively heavy products are supported upon the planar shelf member of the shelf, it is not uncommon for the weight and imbalance of the products to cause the shelf and the products thereon to dislodge and/or drop with attendant damage (breakage, spillage, etc.). At times a cantilevered shelf with articles/products thereon is partially unhooked from the vertical support rails of the refrigerator compartment and tilts or cants which causes the articles/products to slide off the shelf with resultant damage even though the shelf itself does not drop. Therefore, cantilevered shelves which are designed to be step-adjusted relative to shelf tracks or channels provided on the rear wall of a refrigerator are susceptible to damage during adjustment, along with the products/articles supported thereon.

SUMMARY OF THE INVENTION

Accordingly, the present invention provides a refrigerator shelf assembly defined in part by a conventional shelf, namely, a pair of metal support brackets, a planar shelf member, preferably made of clear tempered glass, and an injection molded encapsulation, border or rim unitizing the shelf brackets and the planar shelf member. However, the invention provides a novel adapter bracket utilized in pairs, one with each shelf support bracket. Each adapter bracket is preferably constructed from metal and includes front and rear edges along the latter of which is a slideway or channel into which opens a plurality of vertically spaced slots. The rear edge of each bracket includes hooks for hooking in the vertical slots of conventional vertical shelf tracks provided on the rear wall of a refrigerator. Each shelf support bracket also includes a pair of oppositely projecting projections or supports which are vertically spaced from each other a distance corresponding to the slots in the adapter bracket. Moreover, the distance between the ends of the adapter bracket projections, as measured across the width of the shelf assembly, corresponds substantially to the same distance between the channels but is less than the distance between support edges defined by the vertical slots of the adapter brackets. The latter dimensional relationships permit the shelf brackets of the shelf to be moved upwardly and downwardly in the slideways or channels without being fully disassembled therefrom thereby precluding inadvertent or accidental disassembly of the shelf from the adapter brackets. The adapter brackets preferably include hooks which are hooked into the slots, openings or notches of the shelf track and remain so attached when the shelf is adjusted vertically upwardly or downwardly. In this fashion the shelf is never bodily removed from the adapter brackets and the adapter brackets are never bodily disconnected from the shelf tracks of the refrigerator compartment unless done intentionally.

In further accordance with the invention, the projecting supports of the shelf brackets and the slideways and slots of the adapter brackets are so related that should the shelf be accidentally released when the shelf bracket projections are in the slideways, the weight of the cantilevered shelf, with or without products/articles thereon, tilts or cants the cantilevered shelf forwardly and downwardly which automatically introduces a lowermost of the shelf bracket projections into associated slots of the adapter brackets which bottom against support edges of the slots and automatically lock the cantilevered shelf in the position of a slight forward tilt. In this manner the entire shelf and the articles/products supported thereon will not drop and most, if not all, products/articles will be retained upon the glass shelf member thereof.

The novel shelf assembly and the pair of adapter brackets associated therewith thereby effect limited vertical sliding movement to space shelves different vertical distances from each other but permit the latter to be accomplished without bodily or entirely disconnecting the shelf from the adapter brackets and the adapter brackets from the shelf tracks. The latter, with the automatic locking feature latter described, virtually eliminates inadvertent/accidental shelf, shelf assembly, product and/or article breakage or damage during vertical shelf adjustment.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 4 is a rear perspective view of one of the adapter brackets, and illustrates three hooks along a rear edge thereof with one of the hooks being offset from the remaining two, a slideway or channel along a front edge, and a plurality of equally vertically spaced slots between the front and rear edges opening partially into the slideway.

FIG. 5 is a side elevational view of the adapter bracket of the invention, and illustrates the manner in which each slot is in part defined by a lower transition ledge or edge which extends from the slideway and ends in a substantially horizontally disposed support or supporting edge.

DESCRIPTION OF THE PREFERRED EMBODIMENTS

Figure 1:
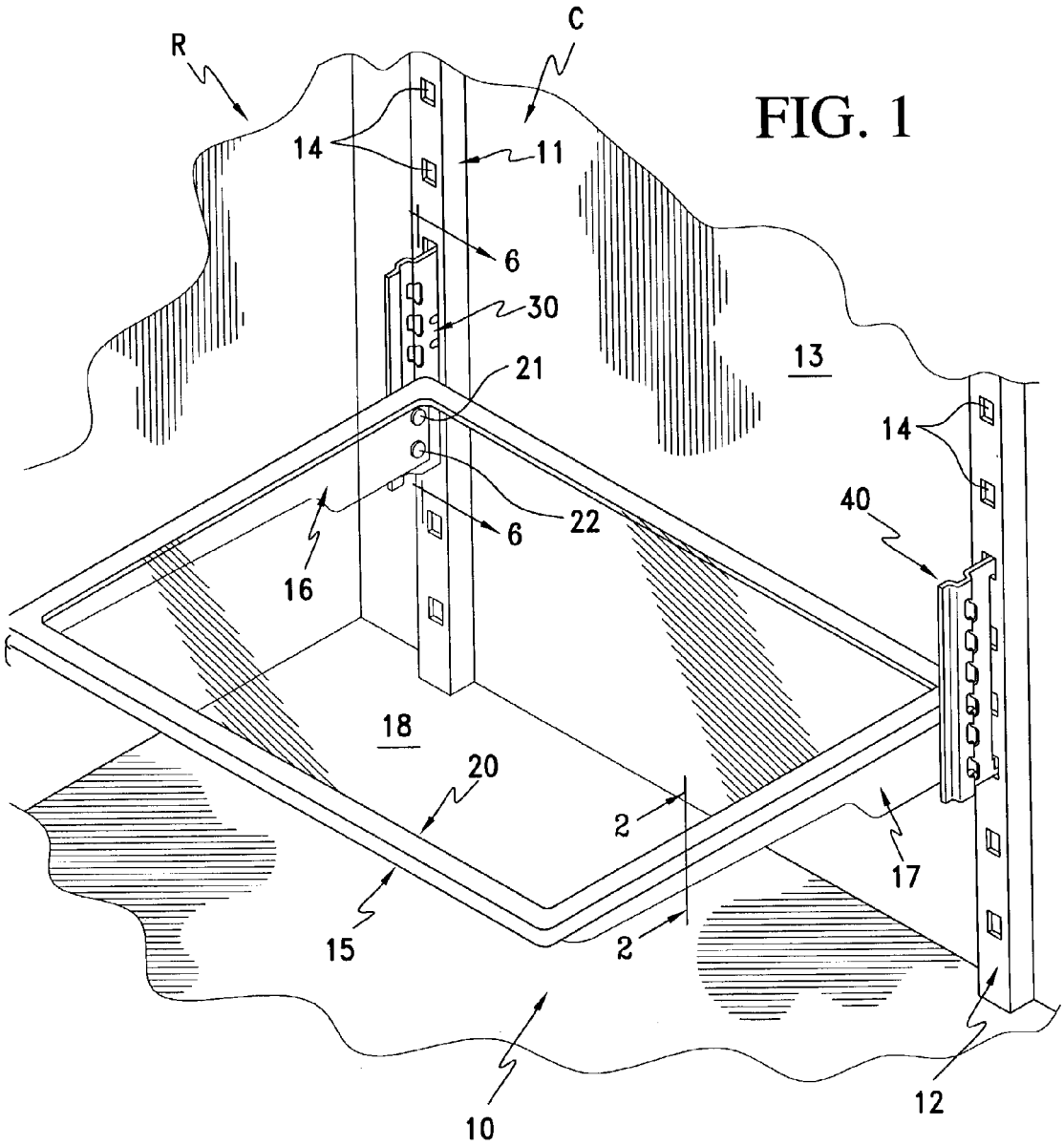
FIG. 1 is a perspective view of a refrigerator, a refrigerator compartment thereof, slotted vertical shelf tracks along a rear wall of the compartment, and a novel shelf assembly of the invention defined by a shelf having an injection molded encapsulation or rim unitizing a tempered glass shelf member to a pair of metal shelf support brackets, each having a pair of vertically spaced outwardly directed projecting supports, and the latter being interlocked in and supported by edges of vertically spaced slots of a pair of adapter brackets hooked into the slots of the shelf tracks.

A novel refrigerator shelf assembly constructed in accordance with the present invention is generally designated by the reference numeral 10, and is illustrated in FIG. 1 in association with a cabinet or compartment C of a refrigerator R having a pair of horizontally spaced substantially vertically disposed parallel members or shelf tracks 11, 12 secured to or formed as an integral portion of a rear wall 13 of the compartment C. Each shelf track 11, 12 includes a plurality of relatively narrow elongated slits, openings or slots 14 along the length thereof. Such slots 14 normally receive hooks of brackets of conventional of shelves of the type disclosed in U.S. Pat. No. 5,362,145 granted on Nov. 8, 1994 to Bird et al. Such conventional shelves can be completely unhooked from and re-hooked to the slots of the shelf tracks to effect stepwise vertical adjustments of the shelves relative to other shelves and/or top and bottom walls of an associated refrigerator compartment. However, as was noted earlier herein, a disadvantage of such total disconnection between conventional shelf hooks and conventional shelf tracks can result in inadvertent or accidental shelf and/or product dropage and resultant damage or breakage. The latter is precluded by the novel refrigerator shelf assembly of the present invention.

Figure 2:
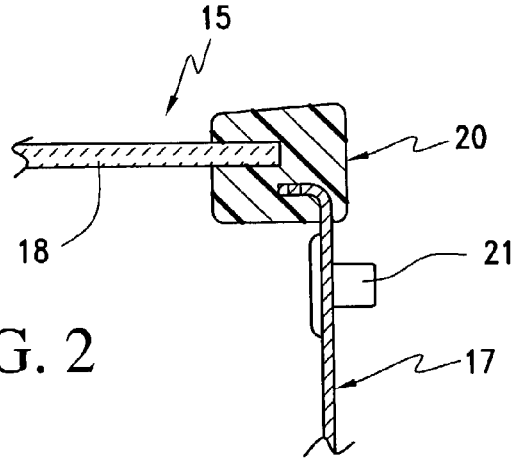
FIG. 2 is an enlarged fragmentary cross-sectional view taken generally along line 2—2 of FIG. 1, and illustrates the manner in which the injection molded encapsulation, border or rim of the shelf units the tempered glass shelf member to one of the shelf brackets.
Figure 6:
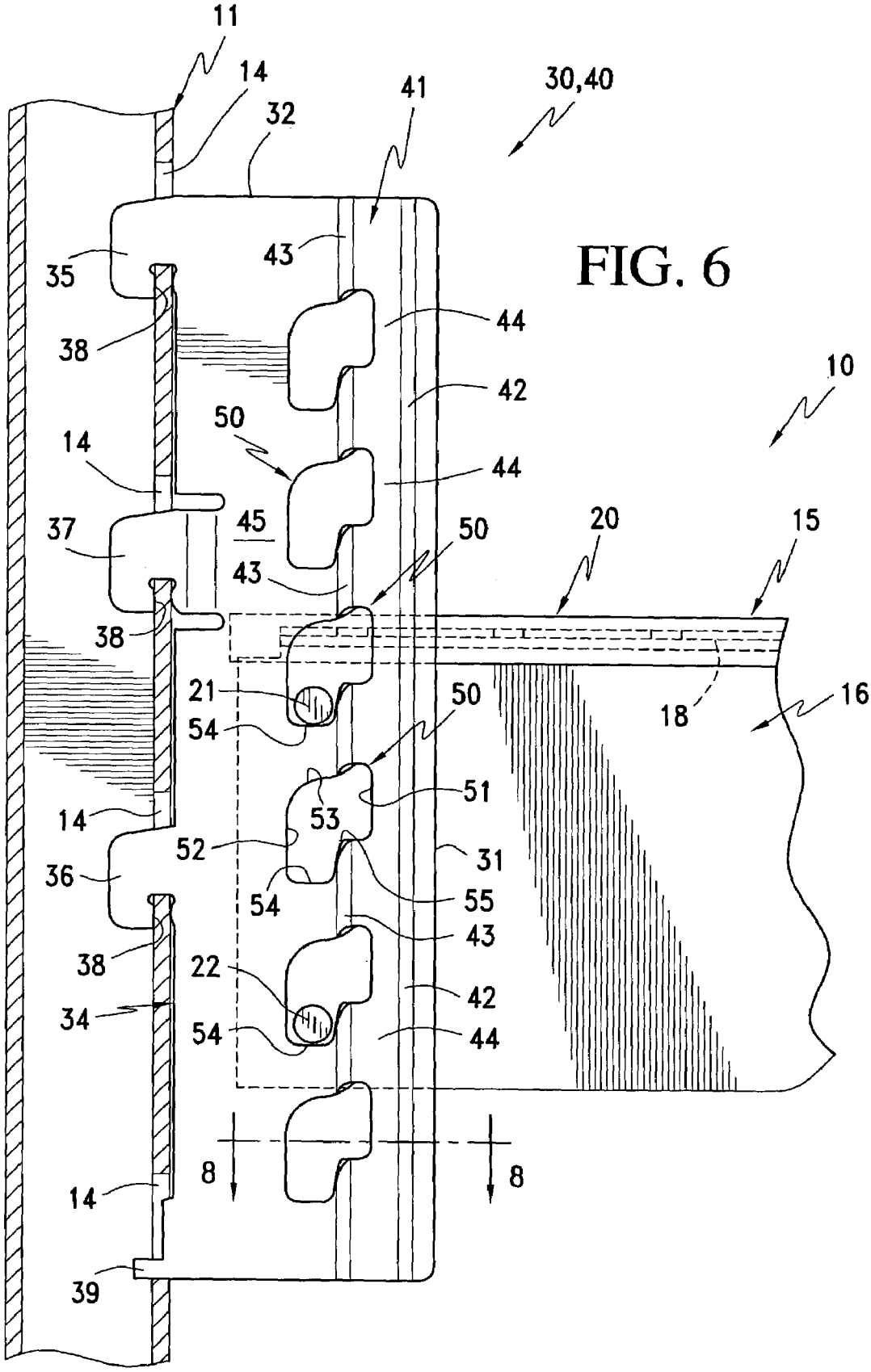
FIG. 6 is an enlarged fragmentary cross-sectional view taken generally along line 6—6 of FIG. 1, and illustrates one of the adapter brackets hooked in openings of one of the shelf tracks and a pair of the projecting supports of one of the shelf brackets seated upon supporting edges of a pair of the slots of the adapter bracket.

The shelf assembly 10 includes a shelf 15 defined by opposite substantially parallel metal shelf brackets 16, 17 unitized to a peripheral edge (unnumbered) of a shelf member 18 of tempered glass by an injection molded encapsulation, rim or border 20 (FIG. 2) formed in the manner described in the latter patent which is incorporated here at by reference. Each shelf bracket 16, 17 includes a pair of projecting supports 21, 22 spaced a predetermined vertical distance from each other (FIG. 6) with axes (unnumbered) thereof in vertical alignment, as is apparent from FIG. 6. The shelf bracket projections or projecting supports 21, 22 project in opposite directions, as is most apparent in FIG. 3 of the drawings, and are spaced a maximum effective distance D1, as measured between terminal end faces (unnumbered) thereof for a purpose and function to be described more fully hereinafter. The refrigerator shelf assembly 10 further includes a pair of substantially identical shelf adapter brackets 30, 40 (FIG. 1) which differ only in the sense of being mirror images for respective left hand and right hand assembly to the respective shelf tracks 11 and 12 (FIG. 1).

Each shelf adapter bracket 30, 40 (FIGS. 4 through 6 and 8) is blanked and formed from a piece of relatively rigid metallic material, and includes a relatively straight front edge or edge portion 31, a top edge or edge portion 32 and a bottom edge or edge portion 33. A rear edge or edge portion 34 opposite the front edge 31 is relatively irregular and defines connecting means in the form of an upper hook 35, a lower hook 36, and a middle hook 37 therebetween. The hooks 35 through 37 are in part defined by slots 38. The hooks 35, 36 lie in a common vertical plane (FIGS. 3 and 4) while the hook 37 is offset in a plane parallel to the plane of the hooks 35, 36, as is most readily apparent in FIG. 3 of the drawings. A locking tab 39 (FIG. 5) projects rearwardly and the bottom edge 33 thereof seats against a bottom edge (FIG. 6) of an associated slit 14 of the respective shelf track 11, 12. The hooks 35 through 37 and the locking tab 39 are conventionally dimensionally related to the slits 14 of the shelf tracks 11, 12 to effect the locked relation thereof illustrated in FIG. 6, but upon upward vertical movement of the adapter brackets 30, 40, the slots 38 thereof disengage from the shelf tracks 11, 12 and permit the removal and/or replacement of the adapter brackets 30, 40 to effect "coarse" vertical step adjustment of the shelf assembly 10 along the shelf tracks 11, 12.

Figure 8:
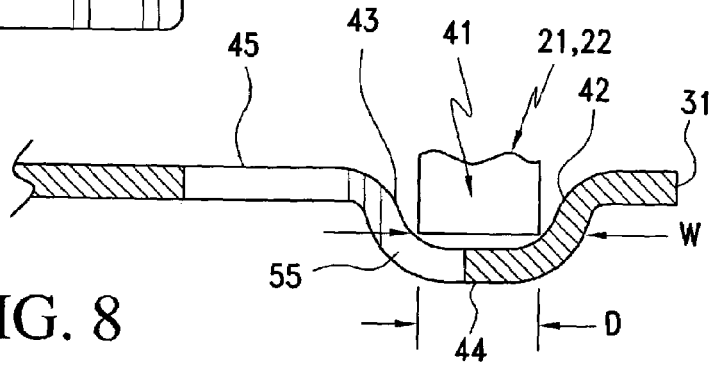
FIG. 8 is highly enlarged cross-sectional view taken generally along line 8—8 of FIG. 6, and illustrates a transition ledge or edge of a slot between one of the slideways or channels of one of the adapter brackets along which a lowermost one of the projecting supports of the shelf brackets automatically travels when the shelf cants or tilts from the upper position shown in FIG. 7 to the lower position shown in FIG. 7 resulting in the automatic locking of the shelf in the latter figure.

Each adapter bracket 30, 40 is provided with a vertical slideway or channel 41 immediately adjacent the front edge 31 and substantially parallel thereto. Each slideway 41 is of a generally U-shaped transverse cross section (FIG. 8) and is defined by a first leg or leg portion 42 most adjacent the front edge 31 (FIG. 8), a second leg or leg portion 43 and a bight portion 44 therebetween. The legs or leg portions 42, 43 are in diverging relationship to each other in a direction away from the bight portion 44 (FIG. 8). The narrowest transverse width W (FIG. 8) of the slideways 41 corresponds substantially to the diameter D (FIG. 8) of the pins 21, 22 to permit relatively vertical sliding movement therebetween. The leg portion 43 of each of the adapter brackets 30, 40 blends with a medial wall portion 45 of each of the adapter brackets 30, 40 (FIG. 5).

A plurality of identical vertically spaced support means 50 in the form of slots or openings 50 are formed along the length of the medial portion 45 between the upper edge 32 and the lower edge 33. Each slot 50 includes a front vertical edge 51, a rear vertical edge 52 and a slightly curved top edge 53. The edges 51, 52 are substantially parallel to each other and are parallel to the front edge 31 of the associated adapter bracket 30, 40. A lower edge or ledge of each slot 50 includes a lowermost substantially horizontally disposed edge or ledge 54 defining means for supporting the projecting supports or projections 21, 22 (FIG. 6) of the shelf brackets 16, 17. A curved transition edge or ledge 55 extends from the edge 51 to the edge 54 beginning at a point midway in the bight portion 44 (FIG. 8) of the slideway 41 (FIG. 8), continuing along the leg portion 43 (FIG. 8) and ending at a merge point (unnumbered) with the supporting ledge or edge 54.

The purpose and function of the transition edges or ledges 55 of the adapter brackets 30, 40 is to permit the projecting supports or pins 21, 22 of the shelf brackets 16, 17 ready entry from the associated slideway 41 toward and downwardly upon the support edges 54 of the slots 50 and the like ready removal thereof in an opposite direction for purposes of assembling or vertically slidably "fine tune" adjusting the shelf 15 relative to the shelf tracks 11, 12, as will be more apparent immediate hereinafter.

Figure 3:
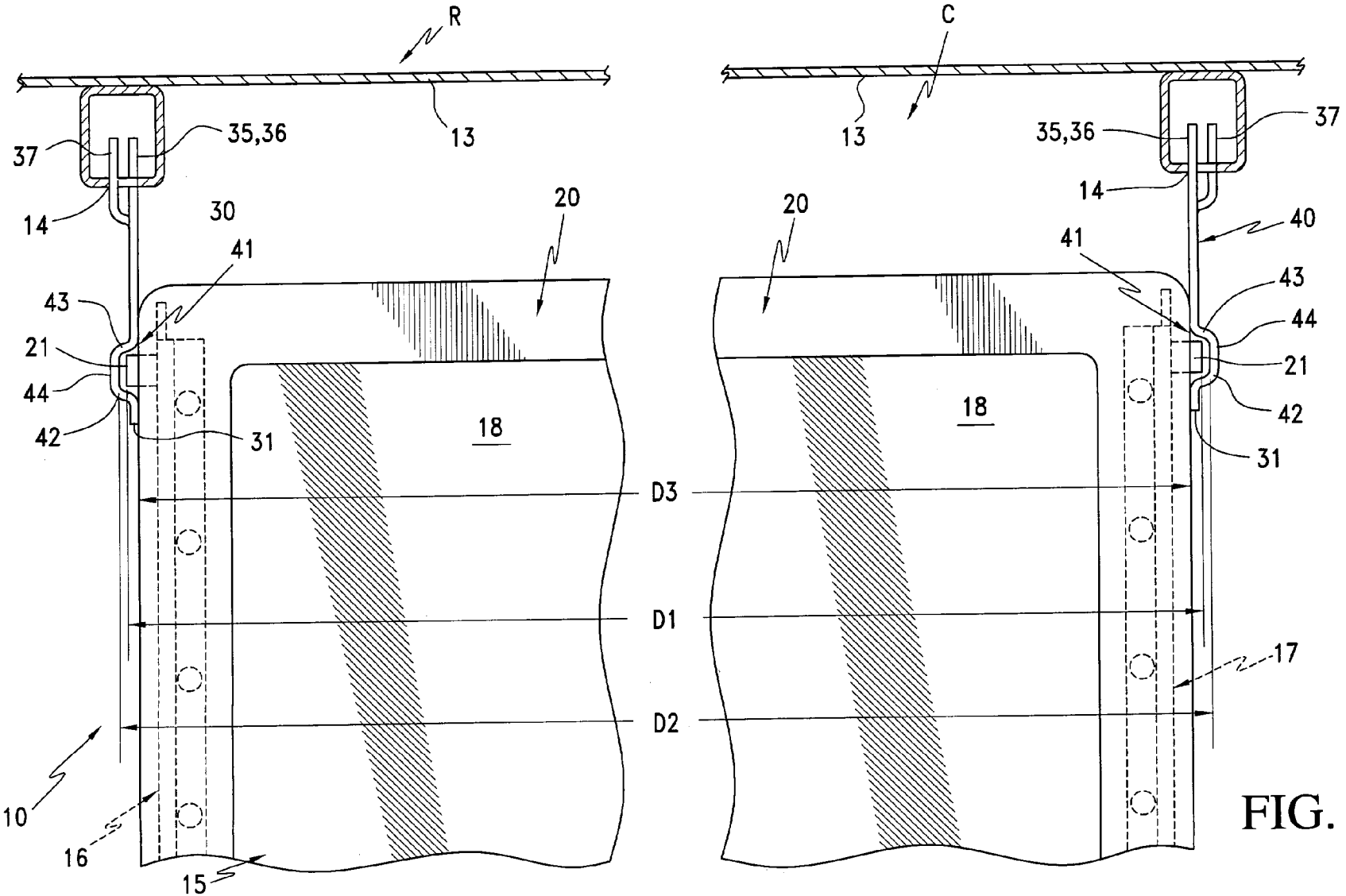
FIG. 3 is an enlarged fragmentary top view taken from above in FIG. 1, and illustrates the manner in which the pair of adapter brackets are hooked to the shelf tracks and the shelf bracket projecting supports are received in the opposing vertical slideways or channels of the adapter brackets to effect vertical adjusting movement of the shelf.

As is best illustrated in FIG. 3, the shelf bracket supporting pins or supports 21, 22 are spaced from each other the distance D1 which is slightly less than an effective distance D2 (FIG. 3) measured between the bight portions 44 of the slideways 41 of adjacent adapter brackets 30, 40. Because of the slight differences in the distances D1, D2, the projecting pins or projecting supports 21, 22 move readily easily vertically upwardly and downwardly relative to the slideways 41. Assuming, for example, that the adapter brackets 30, 40 have been connected through the hooks 35 through 37 thereof in any three of the slits 14 of the respective shelf tracks 11, 14 to effect "coarse" location, the pins 21, 22 of the shelf 15 can be introduced into the slideways 41 (FIG. 3) from the top down or from the bottom up, as viewed in FIG. 1. Once the shelf 15 reaches a desired position, the shelf 15 is pushed inwardly toward the shelf tracks 11, 12 at which point the projecting pins 21, 22 engage and are guided downwardly by the upper edges 53 of the associated slots 50. Thereafter the shelf 15 is pushed downwardly until the supporting pins or supports 21, 22 rest upon the support edges or ledges 54 of the slots 50. Since the slideways 41 oppose each other (FIG. 3), the leg portions 43 thereof are in converging relationship to each other in a direction away from the front edges 31 of the adapter brackets 30, 40 and toward the interior of the compartment C. Therefore, during the inward movement of the supporting pins 21, 22 from within the slideways 41, 41 (FIG. 3), the pins 21, 22 move along the converging edges 55 (FIG. 8) progressively from the outermost distance D2, measured across the bight walls 44, 44 of the slideways 41, 41, to the distance D3 (FIG. 3) which is the maximum distance between horizontally adjacent supporting edges 54. In this manner, the transition edges 55, 55 of horizontally adjacent slots 50, 50 contact and guide the associated supported pins 21, 22 of the shelf brackets 16, 17 of the shelf 15 from the slideways 41, 41 toward and upon the support edges 54 (FIG. 6) and conversely away from the support edges 54 and into the slideways 41 (FIG. 3).

It is to be particularly noted that during any of the vertical adjustment just described of the shelf 15 relative to the adapter brackets 30, 40, and specifically during the movement of the projecting pins or supports 21, 22 of the shelf brackets 16, 17 relative to the slots 50 and the slideway 41, there is no total disassembly of the shelf 15 relative to the adapter brackets 30, 40 and/or the shelf tracks 11, 12. Therefore, during "fine tune" vertical adjustment, it is extremely unlikely that the shelf 15, with or without products/articles thereupon, will be inadvertently dropped or tilted because during any such adjusting movement the projecting pins 21, 22 are at all times in contact with portions of the adapter brackets 30, 40, be it the slots 50 or the slideways 41 thereof (FIG. 3). It is only upon moving the projecting pin 21, 22 upwardly or downwardly along their associated slideway 41, 41 that the shelf 15 can drop substantially vertically, and only upon the removal of all four projecting supports 21, 22 from the slideways 41, 41, could the shelf 15 drop to the bottom of the compartment.

Figure 7:
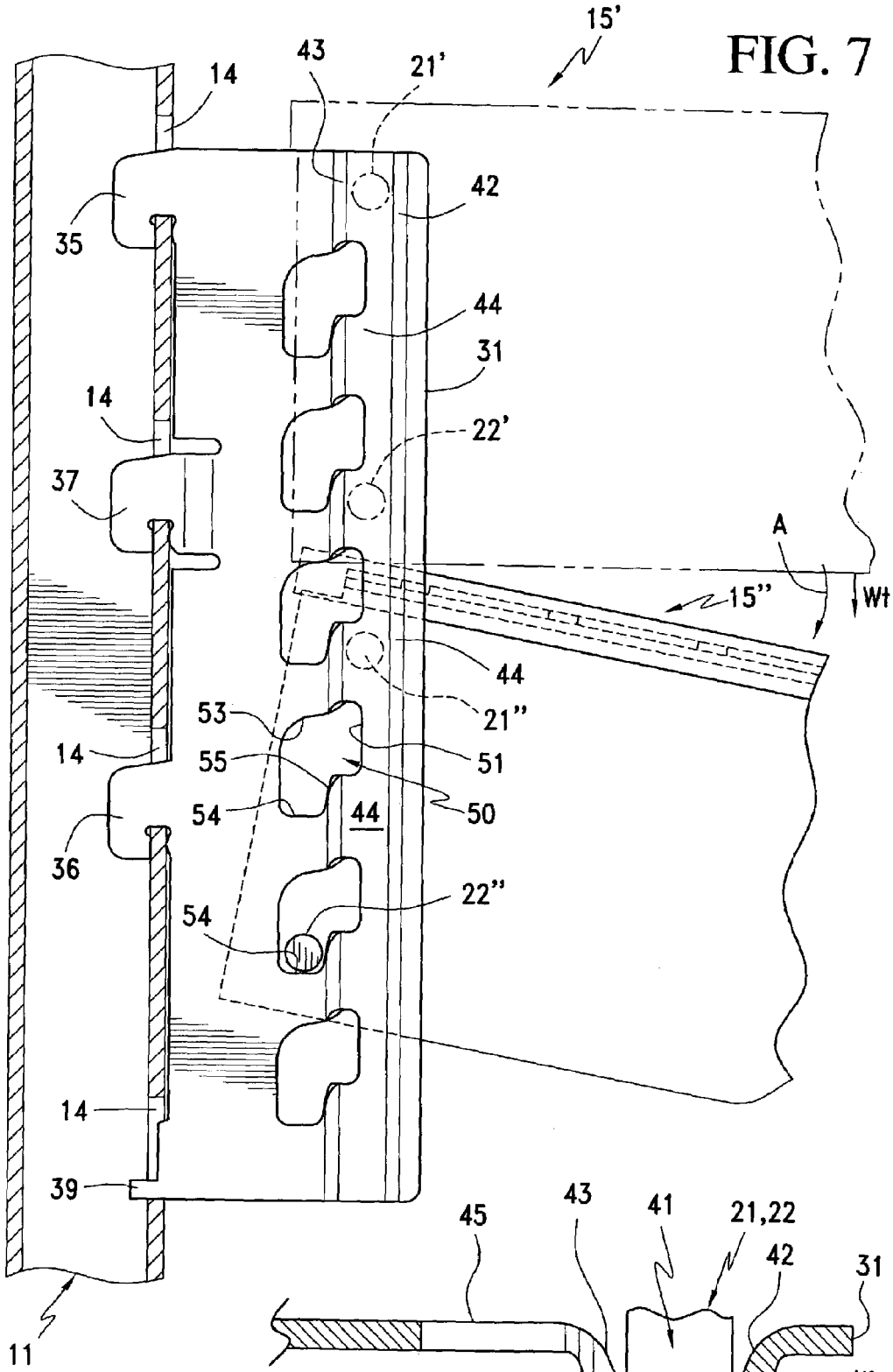
FIG. 7 is a fragmentary cross-sectional view similar to FIG. 6, and illustrates a lower position automatically acquired by the shelf when inadvertently or accidentally released or dropped from the illustrated upper position while the shelf bracket projecting supports are in the slideways.

Reference is made to FIG. 7 of the drawings which illustrates in phantom outline an upper shelf 15' which has been inserted from above to the position illustrated by a person grasping the shelf 15' and sliding the same vertically downwardly to the position illustrated in which the projecting supports 21', 22' are housed substantially centrally of the slideways, in the manner illustrated in FIGS. 3 and 8. It is assumed that the shelf 15' has no products or articles supported thereupon and, therefore, only its weight Wt will effect its downward vertical pivoting and/or tilting movement. If the shelf 15' were released, it would begin to fall vertically because of gravity acting upon its weight Wt, but since the shelf 15' is cantilevered, it will also pivot, tilt or cant in a clockwise direction, as indicated by the curved line of travel A, bringing the upward projecting supports 21' into bearing engagement with the front leg portions 42 of the slideways 41, 41 and the projecting supports 22' into bearing engagement with the rear leg portions 43 of both slideways 41, 41. If the slots 50 did not project into the bight portions 44, the shelf 15' would most assuredly continue a downward slide while being slight cocked or tilted with the projecting supports 21', 22' bearing against the respective front and rear leg portions 42, 43 of the slideways 41, 41 until dropping out the bottom thereof. However, since the slots 50, 50 include ledge or edge portions 55 (FIG. 8) which begin within the medial portion 44 of the slideways 41, 41, the lowermost projecting supports 22" (FIG. 7) eventually reach one of the slots 50 devoid of an inner leg portion 43 which allows the projecting supports 22" to progressively enter horizontally aligned slots 50 of the adapter brackets 30, 40 eventually overlying the transition edges 55 thereof which guide the lowermost projecting supports 22" toward and upon the support edges 54, as is indicated by the shelf 15" which can neither tilt further nor slide vertically down beyond the position illustrated. Therefore, the adapter brackets 30, 40 can not only be selectively positioned within the slots 14 of the shelf tracks 11, 12 to in essence provide a "coarse" adjustment of the shelf assembly 10, but thereafter the shelf 15 can be adjusted along the slideways 41 of the adapter brackets 30, 40 to any one of a number of vertically desired positions of "fine" adjustment absent fear of disengagement of the shelf 15 from the adapter brackets 30, 40. The latter function is extremely important because even under a worse case scenario (shelf 15" of FIG. 7), the shelf 15" will not drop from the adapter brackets 30, 40 and will not tilt beyond that illustrated in FIG. 7. Even should the latter occur while articles or products were being supported upon the shelf 15', a person most likely could prevent the articles/products from falling because both hands could be utilized for the latter purpose, as opposed to being used to essentially both catch products and/or articles and hold the shelf 15".

Though the adapter brackets 30, 40 are preferably constructed from relatively rigid metallic material, the same can be formed from synthetic polymeric or copolymeric plastic material. Furthermore, in lieu of individual shelf brackets 16, 17 constructed from metallic material, the shelf brackets 16, 17 and the projecting supports 21, 22 thereof can be injection molded simultaneously with the injection molding of the encapsulation or rim 20, such as is disclosed with respect to FIG. 2 of U.S. Pat. No. 5,273,354. The shelf bracket 16, 17 and the projections 21, 22 can each be a single piece of molded plastic material and then unitized to the planar tempered glass panel 18 by an injection molded encapsulation or rim 20, as is more specifically disclosed with respect to FIG. 4 of U.S. Pat. No. 5,273,354.

Figure 9:
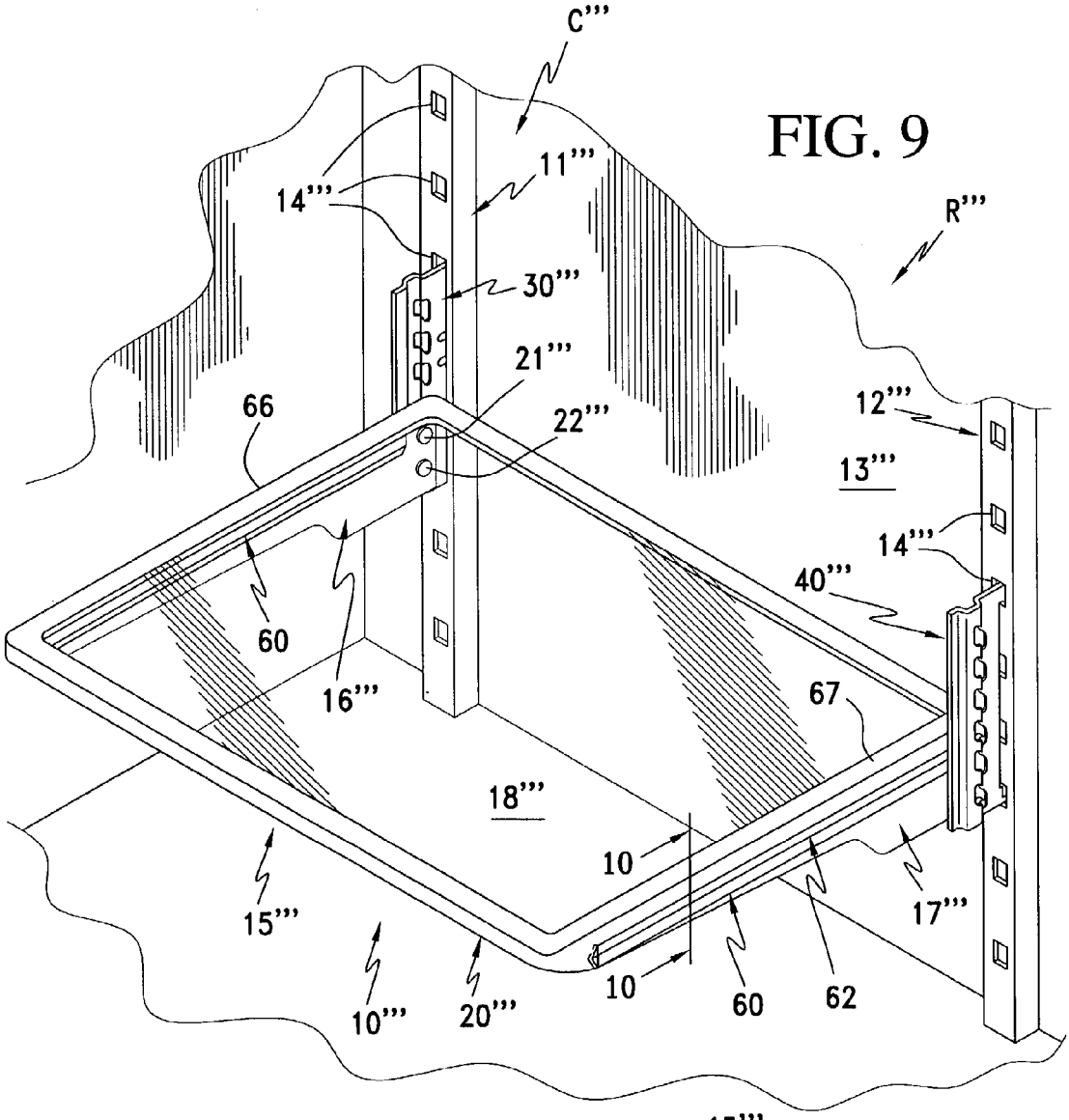
FIG. 9 is a perspective view of a refrigerator, a refrigerator compartment thereof, slotted vertical shelf tracks along a rear wall of the compartment, and a novel shelf assembly of the invention defined by a shelf having an injection molded encapsulation or rim unitized to a peripheral edge of a tempered glass shelf member which in turn has channels for effecting inward and outward sliding movement of the shelf relative to a pair of metal shelf support brackets, each having a pair of vertically spaced outwardly directed projecting supports, and the latter being interlocked in and supported by edges of vertically spaced slots of a pair of adapter brackets hooked into the slots of the shelf tracks.
Figure 10:
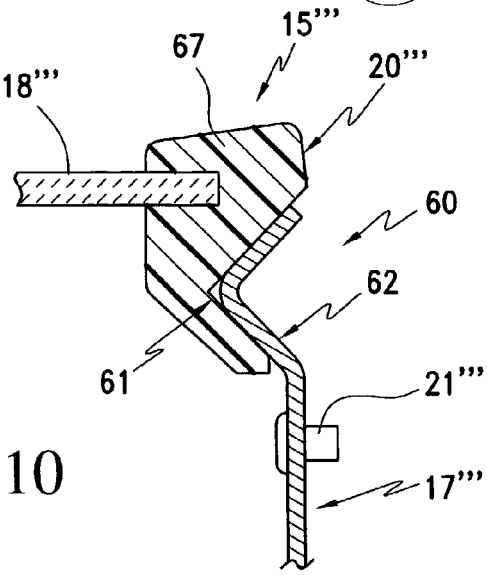
FIG. 10 is an enlarged fragmentary cross-sectional view taken generally along line 10—10 of FIG. 9, and illustrates the manner in which the rim of the shelf is in sliding engagement with one of the shelf brackets.

Another novel refrigerator shelf assembly constructed in keeping with the present invention is illustrated in FIGS. 9 and 10 of the drawings and is generally designated by the reference numeral 10'''. All structure and components of the refrigerator shelf assembly 10''' which are identical to the refrigerator shelf assembly 10 of FIGS. 1 and 2 bear the same reference numerals and reference characters but are primed.

The refrigerator shelf assembly 10''' is illustrated in FIG. 9 in association with a cabinet or compartment C''' of a refrigerator R''' having a pair of horizontally spaced substantially vertically disposed parallel members or shelf tracks 11''', 12''' secured to or formed as an integral portion of a rear wall 13''' of the compartment C'''. Each shelf track 11''', 12''' includes a plurality of relatively narrow elongated slits, openings or slots 14''' along the length thereof which normally receive hooks of brackets to permit shelves to be completely unhooked from and re-hooked to the slots of the shelf tracks to effect stepwise vertical adjustments of the shelves relative to other shelves and/or top and bottom walls of an associated refrigerator compartment.

The shelf assembly 10''' includes a shelf 15''' defined by opposite substantially parallel metal shelf brackets 16''', 17''' unitized to a peripheral edge (unnumbered) of a shelf member 18''' of tempered glass by an injection molded encapsulation, rim or border 20''' (FIG. 10) formed in the manner described in U.S. Pat. No. 5,362,149. Each shelf bracket 16''', 17''' includes a pair of projecting supports 21''', 22''' spaced with respect to each other and with respect to adapter brackets 30''', 40''' in the same manner heretofore described relative to the shelf assembly 10.

The shelf assembly 10''' differs from the shelf assembly 10 in that the shelf 15''' and specifically the rim 20''' and the metal shelf brackets 16''', 17''' are provided with cooperative means 60 for effecting substantial horizontal sliding movement of the shelf 15''' relative to the shelf brackets 16''', 17'''. The cooperative sliding means 60 includes an outwardly opening generally V-shaped channel, slideway or groove 61 in each of opposite sides 66, 67 of the rim 20'''. The channels 61 open in opposite directions and received therein a generally V-shaped longitudinally extending rib or slider 62 formed in each of the metal shelf brackets 16''', 17'''. The ribs 62, 62 of the shelf brackets 16''', 17''' are directed toward each other and each is in intimate sliding relationship to an associated one of the channels 61 of the sides 66, 67 of the rim 20'''. The channels 61 are open (not shown) at the ends thereof most adjacent the rear wall 13''' of the compartment C''' and are closed at ends remote therefrom, as is readily apparent in FIG. 9. The latter construction allows the shelf 10''' to be slid forwardly for insertion and rearwardly for removal from the shelf brackets 16''', 17'''. The shelf assembly 10''' is therefore essentially identical to the shelf assembly 10 except for the slidable/unitized relationships, respectively, thereof.

It should be recognized that refrigerator manufacturers have individualized shelf adjusting and/or shelf attaching systems, as can be readily observed by inspecting refrigerators sold by or under the names of Maytag, Amana, General Electric, Whirlpool, Frigidaire, Sub-Zero, Viking, Camco, etc. The shelf tracks 11, 12 and the slits or slots 14 associated therewith for the latter group of refrigerators can vary in numbers, shapes, sizes, orientations, distances therebetween, etc. However, in accordance with this invention, the shelf assemblies 10, 10', 10'' and/or 10''' can be utilized with any such refrigerator and any variations in the shelf tracks thereof by simply varying the size, shape, number, orientation, vertical distance, etc. of the hooks 35–37 (FIGS. 4 through 6) of the shelf adapter brackets 30, 40.

Although a preferred embodiment of the invention has been specifically illustrated and described herein, it is to be understood that minor variations may be made in the apparatus without departing from the spirit and scope of the invention, as defined by the appended claims.

What is claimed is:

1. A vertically adjustable shelf comprising a pair of first and second members disposed in substantially vertically sliding relationship to each other, the first members of each pair being disposed in substantially vertically disposed transversely spaced relationship to each other, each first member having a substantially vertically disposed slideway, said slideways defining a first distance therebetween, each first member further including a plurality of substantially vertically spaced supports opening into each of said slideways, a second effective length between the spaced supports of opposite slideways defining a second effective distance different than said first distance, each second member having at least a pair of supports, a third effective distance between said second members pairs of supports being between said first and second distances wherein (a) said pair of second members are relatively vertically slidable when said second members pairs of supports are disposed within said slideways and (b) said pair of second members are relatively vertically nonslidable when said second members pairs of supports are disposed upon said first members supports, and a shelf carried by said second members.

2. The vertically adjustable shelf as defined in claim 1 wherein each of said first members includes means for securing each first member to a vertical support.

3. The vertically adjustable shelf as defined in claim 1 including a pair of third members in substantially transversely spaced vertically disposed relationship, and means for connecting one first member to one third member.

4. The vertically adjustable shelf as defined in claim 1 including a pair of third members in substantially transversely spaced vertically disposed relationship, and means for stepwise connecting one first member to one third member.

5. The vertically adjustable shelf as defined in claim 1 wherein said shelf includes a substantially horizontally disposed panel, and polymeric encapsulation means for uniting said panel to said second members.

6. The vertically adjustable shelf as defined in claim 1 wherein said shelf includes a substantially horizontally disposed panel having a peripheral edge including peripheral edge portions, and polymeric encapsulation means for uniting said second members to said peripheral edge portions of said panel peripheral edge.

7. The vertically adjustable shelf as defined in claim 1 wherein said shelf includes a substantially horizontally disposed panel having a peripheral edge, and polymeric encapsulation means for at least partially encapsulating a portion of said panel peripheral edge and uniting said second members thereto.

8. The vertically adjustable shelf as defined in claim 1 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

9. The vertically adjustable shelf as defined in claim 1 wherein said shelf includes a substantially horizontally disposed glass panel having a peripheral edge, and polymeric encapsulation means for at least partially encapsulating a portion of said panel peripheral edge and uniting said second members thereto.

10. The vertically adjustable shelf as defined in claim 1 wherein said shelf includes a substantially horizontally disposed glass panel having a peripheral edge and at least two corner portions, and polymeric encapsulation means for at least partially encapsulating a portion of said panel peripheral edge and uniting said second members substantially proximate said corner portions.

11. The vertical adjustable shelf as defined in claim 1 wherein said first members are metal.

12. The vertical shelf adjustable shelf as described in claim 1 wherein each first member has a front edge and a rear edge, and each first member slideway and first member plurality of supports are respectively adjacent and remote from one of said front and rear edges.

13. The vertical shelf adjustable shelf as described in claim 1 wherein each first member has a front edge and a rear edge, and each first member slideway and first member plurality of supports are respectively adjacent and remote from said front edges.

14. The vertical adjustable shelf as described in claim 1 wherein said first member plurality of supports are defined by edges of slots.

15. The vertical adjustable shelf as defined in claim 1 wherein said first member plurality of supports are each defined by a substantially horizontal ledge.

16. The vertical adjustable shelf as defined in claim 1 wherein said first member plurality of supports are each defined by a substantially horizontal ledge, and a transition wall between each substantially horizontal ledge and its associated slideway.

17. The vertical adjustable shelf as defined in claim 1 wherein said slideways are each of a substantially U-shaped transverse cross section defined by a bight wall between a pair of leg walls, and said first member plurality of supports are each defined by a ledge adjacent one of said leg walls.

18. The vertical adjustable shelf as defined in claim 1 wherein said slideways are each of a substantially U-shaped transverse cross section defined by a bight wall between a pair of leg walls, said first member plurality of supports are each defined by a ledge adjacent one of said leg walls, and a transition ledge defined by the leg wall extending between the bight wall and each of said ledges.

19. The vertical adjustable shelf as defined in claim 1 wherein said slideways are each of a substantially U-shaped transverse cross section defined by a bight wall between a pair of leg walls, said first member plurality of supports are each defined by a slot in an inboardmost one of said leg walls and extending inboard therebeyond, and each inboard extending portion of each slot defining one of said first member plurality of supports.

20. The vertically adjustable shelf as defined in claim 1 wherein each first member includes a front edge and a rear edge, each first member slideway and first member plurality of supports are respectively adjacent and remote from said front edge, and means for transitioning the movement of the second member pairs of supports between the slideways and first member plurality of supports.

21. The vertically adjustable shelf as defined in claim 1 wherein each first member includes a front edge and a rear edge, each first member slideway and first member plurality of supports are respectively adjacent and remote from said front edge, means for transitioning the movement of the second member pairs of supports between the slideways and first member plurality of supports, and said transistioning means is each defined by a ledge.

22. The vertically adjustable shelf as defined in claim 1 wherein each first member includes a front edge and a rear edge, each first member slideway and first member plurality of supports are respectively adjacent and remote from said front edge, means for transitioning the movement of the second member pairs of supports between the slideways and first member plurality of supports, and means along each first member and rear edge for connecting each first member to a vertical support.

23. The vertically adjustable shelf as defined in claim 1 wherein each first member includes a front edge and a rear edge, each first member slideway and first member plurality of supports are respectively adjacent and remote from said front edge, means for transitioning the movement of the second member pairs of supports between the slideways and first member plurality of supports, and means along each first member rear edge for hooking each first member to a slot in a vertical support.

24. The vertically adjustable shelf as defined in claim 1 wherein each first member includes a front edge and a rear edge, each first member slideway and first member plurality of supports are respectively adjacent and remote from said front edge, means for transitioning the movement of the second member pairs of supports between the slideways and first member plurality of supports, and said transistioning means is each defined by a slot.

25. The vertically adjustable shelf as defined in claim 1 wherein each first member includes a front edge and a rear edge, each first member slideway and first member plurality of supports are respectively adjacent and remote from said front edge, means for transitioning the movement of the second member pairs of supports between the slideways and first member plurality of supports, said transistioning means is each defined by a slot, and each first member plurality of supports is defined by an edge of each slot.

26. The vertically adjustable shelf as defined in claim 12 wherein said shelf includes a substantially horizontally disposed panel, and polymeric encapsulation means for uniting said panel to said second members.

27. The vertically adjustable shelf as defined in claim 12 wherein said shelf includes a substantially horizontally disposed panel having a peripheral edge including peripheral edge portions, and polymeric encapsulation means for uniting said second members to said peripheral edge portions of said panel peripheral edge.

28. The vertically adjustable shelf as defined in claim 12 wherein said shelf includes a substantially horizontally disposed panel having a peripheral edge, and polymeric encapsulation means for at least partially encapsulating a portion of said panel peripheral edge and uniting said second members thereto.

29. The vertically adjustable shelf as defined in claim 12 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

30. The vertically adjustable shelf as defined in claim 15 wherein said shelf includes a substantially horizontally disposed panel, and polymeric encapsulation means for uniting said panel to said second members.

31. The vertically adjustable shelf as defined in claim 15 wherein said shelf includes a substantially horizontally disposed panel having a peripheral edge including peripheral edge portions, and polymeric encapsulation means for uniting said second members to said peripheral edge portions of said panel peripheral edge.

32. The vertically adjustable shelf as defined in claim 15 wherein said shelf includes a substantially horizontally disposed panel having a peripheral edge, and polymeric encapsulation means for at least partially encapsulating a portion of said panel peripheral edge and uniting said second members thereto.

33. The vertically adjustable shelf as defined in claim 15 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

34. The vertically adjustable shelf as defined in claim 17 wherein said shelf includes a substantially horizontally disposed panel, and polymeric encapsulation means for uniting said panel to said second members.

35. The vertically adjustable shelf as defined in claim 17 wherein said shelf includes a substantially horizontally disposed panel having a peripheral edge including peripheral edge portions, and polymeric encapsulation means for uniting said second members to said peripheral edge portions of said panel peripheral edge.

36. The vertically adjustable shelf as defined in claim 17 wherein said shelf includes a substantially horizontally disposed panel having a peripheral edge, and polymeric encapsulation means for at least partially encapsulating a portion of said panel peripheral edge and uniting said second members thereto.

37. The vertically adjustable shelf as defined in claim 17 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

38. The vertically adjustable shelf as defined in claim 20 wherein said shelf includes a substantially horizontally disposed panel, and polymeric encapsulation means for uniting said panel to said second members.

39. The vertically adjustable shelf as defined in claim 20 wherein said shelf includes a substantially horizontally disposed panel having a peripheral edge including peripheral edge portions, and polymeric encapsulation means for uniting said second members to said peripheral edge portions of said panel peripheral edge.

40. The vertically adjustable shelf as defined in claim 20 wherein said shelf includes a substantially horizontally disposed panel having a peripheral edge, and polymeric encapsulation means for at least partially encapsulating a portion of said panel peripheral edge and uniting said second members thereto.

41. The vertically adjustable shelf as defined in claim 20 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

42. A vertically adjustable shelf comprising a pair of first and second members disposed in substantially vertically sliding relationship to each other, the first and second members of each pair being disposed in substantially vertically disposed transversely spaced relationship to each other; each first member having a front edge, a rear edge and a substantially vertically disposed slideway adjacent the front edge; said slideways defining a first distance therebetween, each first member further including a plurality of substantially vertically spaced supports adjacent each of said slideways, a second effective length between the spaced supports of opposite slideways defining a second effective distance less than said first distance, a transition wall extending between each first member support and an adjacent slideway, horizontally adjacent first member supports defining a third progressively lessening distance from said first distance to said second distance, each second member having at least a pair of supports, a shelf projecting in cantilevered fashion from said second members in a substantially horizontal plane to support articles thereupon, a fourth effective distance between said second members pairs of supports being between said first and second distances wherein (a) said pair of second members are relatively vertically slidable when said second members pairs of supports are disposed within said slideways and (b) said pair of second members are relatively vertically nonslidable when said second members pairs of supports are disposed upon said first members supports, said second member vertically spaced supports being normally in vertical slideways, and upon inadvertent or accidental downward tilting of said cantilevered shelf a lowermost of said second member vertically spaced supports automatically move along horizontally opposite transition walls to seat the second member lowermost supports upon a pair of horizontally aligned first member supports to prevent downward sliding movement of the tilted shelf.

43. The vertically adjustable shelf as defined in claim 42 including a pair of third members in substantially transversely spaced vertically disposed relationship, and means for connecting one first member to one third member.

44. The vertically adjustable shelf as defined in claim 42 including a pair of third members in substantially transversely spaced vertically disposed relationship, and means for stepwise connecting one first member to one third member.

45. The vertically adjustable shelf as defined in claim 42 wherein said shelf includes a substantially horizontally disposed panel, and polymeric encapsulation means for uniting said panel to said second members.

46. The vertically adjustable shelf as defined in claim 42 wherein said shelf includes a substantially horizontally disposed panel having a peripheral edge including peripheral edge portions, and polymeric encapsulation means for uniting said second members to said peripheral edge portions of said panel peripheral edge.

47. The vertically adjustable shelf as defined in claim 42 wherein said shelf includes a substantially horizontally disposed panel having a peripheral edge, and polymeric encapsulation means for at least partially encapsulating a portion of said panel peripheral edge and uniting said second members thereto.

48. The vertically adjustable shelf as defined in claim 42 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

49. The vertical adjustable shelf as described in claim 42 wherein said first member plurality of supports are defined by edges of slots.

50. The vertical adjustable shelf as defined in claim 42 wherein said first member plurality of supports are each defined by a substantially horizontal ledge.

51. The vertical adjustable shelf as defined in claim 42 wherein said slideways are each of a substantially U-shaped transverse cross section defined by a bight wall between a pair of leg walls, said first member plurality of supports are each defined by a slot in an inboardmost one of said leg walls and extending inboard therebeyond, and each inboard extending portion of each slot defining one of said first member plurality of supports.

52. The vertical adjustable shelf as defined in claim 42 wherein said first member plurality of supports and transition walls are defined by slots.

53. The vertically adjustable shelf as defined in claim 49 wherein said shelf includes a substantially horizontally disposed panel, and polymeric encapsulation means for uniting said panel to said second members.

54. The vertically adjustable shelf as defined in claim 49 wherein said shelf includes a substantially horizontally disposed panel having a peripheral edge including peripheral edge portions, and polymeric encapsulation means for uniting said second members to said peripheral edge portions of said panel peripheral edge.

55. The vertically adjustable shelf as defined in claim 49 wherein said shelf includes a substantially horizontally disposed panel having a peripheral edge, and polymeric encapsulation means for at least partially encapsulating a portion of said panel peripheral edge and uniting said second members thereto.

56. The vertically adjustable shelf as defined in claim 49 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

57. The vertically adjustable shelf as defined in claim 50 wherein said shelf includes a substantially horizontally disposed panel, and polymeric encapsulation means for uniting said panel to said second members.

58. The vertically adjustable shelf as defined in claim 50 wherein said shelf includes a substantially horizontally disposed panel having a peripheral edge including peripheral edge portions, and polymeric encapsulation means for uniting said second members to said peripheral edge portions of said panel peripheral edge.

59. The vertically adjustable shelf as defined in claim 50 wherein said shelf includes a substantially horizontally disposed panel having a peripheral edge, and polymeric encapsulation means for at least partially encapsulating a portion of said panel peripheral edge and uniting said second members thereto.

60. The vertically adjustable shelf as defined in claim 50 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

61. The vertically adjustable shelf as defined in claim 51 wherein said shelf includes a substantially horizontally disposed panel, and polymeric encapsulation means for uniting said panel to said second members.

62. The vertically adjustable shelf as defined in claim 51 wherein said shelf includes a substantially horizontally disposed panel having a peripheral edge including peripheral edge portions, and polymeric encapsulation means for uniting said second members to said peripheral edge portions of said panel peripheral edge.

63. The vertically adjustable shelf as defined in claim 51 wherein said shelf includes a substantially horizontally disposed panel having a peripheral edge, and polymeric encapsulation means for at least partially encapsulating a portion of said panel peripheral edge and uniting said second members thereto.

64. The vertically adjustable shelf as defined in claim 51 wherein said shelf includes a substantially horizontally disposed panel having a peripheral edge and at least two corner portions, and polymeric encapsulation means for at least partially encapsulating a portion of said panel peripheral edge and uniting said second members substantially proximate said corner portions.

65. A vertically adjustable shelf comprising a pair of first and second members disposed in substantially vertically sliding relationship to each other, the first and second members of each pair being disposed in substantially vertically disposed transversely spaced relationship to each other, each first member having a substantially vertically disposed slideway, said slideways defining a first distance therebetween, each first member further including a plurality of substantially vertically spaced supports opening into each of said slideways, a second effective length between the spaced supports of opposite slideways defining a second effective distance different than said first distance, each second member having at least a pair of supports, a third effective distance between said second members pairs of supports being between said first and second distances wherein (a) said pair of second members are relatively vertically slidable when said second members pairs of supports are disposed within said slideways and (b) said pair of second members are relatively vertically nonslidable when said second members pairs of supports are disposed upon said first members supports, a shelf carried by said second members, and means for sliding said shelf relative to said second members.

66. The vertically adjustable shelf as defined in claim 65 wherein each of said first members includes means for securing each first member to a vertical support.

67. The vertically adjustable shelf as defined in claim 65 including a pair of third members in substantially transversely spaced vertically disposed relationship, and means for connecting one first member to one third member.

68. The vertically adjustable shelf as defined in claim 65 including a pair of third members in substantially transversely spaced vertically disposed relationship, and means for stepwise connecting one first member to one third member.

69. The vertically adjustable shelf as defined in claim 65 wherein said shelf includes a substantially horizontally disposed panel having a peripheral edge at least bordered in part by side border portions, and said sliding means are defined by portions of said second members in sliding relationship with said border portions.

70. The vertically adjustable shelf as defined in claim 65 wherein said shelf includes a substantially horizontally disposed panel having a peripheral edge, polymeric mans for at least partially bordering said peripheral edge, and said sliding means are defined by portions of said second members in sliding relationship with said polymeric bordering means.

71. The vertically adjustable shelf as defined in claim 65 wherein said shelf includes a substantially horizontally disposed panel having a peripheral edge at least bordered in part by side border portions, said sliding means are defined by portions of said second members in sliding relationship with said border portions, and said sliding means portions are ribs and channels in relative sliding relationship to each other.

* * * * *